United States Patent [19]

Patel

[11] 4,035,648

[45] July 12, 1977

[54] X-RAY TUBE PROTECTION CIRCUIT

[75] Inventor: Ambalal T. Patel, Baltimore, Md.

[73] Assignee: CGR Medical Corporation, Baltimore, Md.

[21] Appl. No.: 720,058

[22] Filed: Sept. 2, 1976

[51] Int. Cl.[2] ..... H05G 1/30

[52] U.S. Cl. ..... 250/402; 250/409

[58] Field of Search ..... 250/409, 413, 416 R, 250/402

[56] References Cited

U.S. PATENT DOCUMENTS

| | | | |
|---|---|---|---|
| 3,746,862 | 7/1973 | Lombardo et al. | 250/409 |
| 3,838,285 | 9/1974 | Siedband et al. | 250/413 |
| 3,968,372 | 7/1976 | Laughinghouse | 250/409 |

*Primary Examiner*—Alfred E. Smith
*Assistant Examiner*—T. N. Grigsby
*Attorney, Agent, or Firm*—Brady, O'Boyle & Gates

[57] ABSTRACT

An eight bit binary address signal is generated in response to a selected time station, X-ray tube, focal spot and anode rotation speed which is then used to address a read only memory (ROM) pre-programmed with specific binary representations of exact values on the manufacturer's high set rating chart curves which represents the maximum power allowed for each selected type of X-ray exposure desired. Once the exposure parameters are selected, the read only memory outputs a unique binary digital signal which is fed into a digital to analog converter which in turn generates an equivalent analog voltage. This analog voltage of maximum allowable power is then compared against the power (kV × mA) selected to inhibit further operation if an unsafe condition exists or thereafter cause a proper adjustment to occur while permitting an X-ray exposure for a safe condition, thus allowing the radiologist to utilize the X-ray tube to its fullest capability.

10 Claims, 6 Drawing Figures

FIG. 3
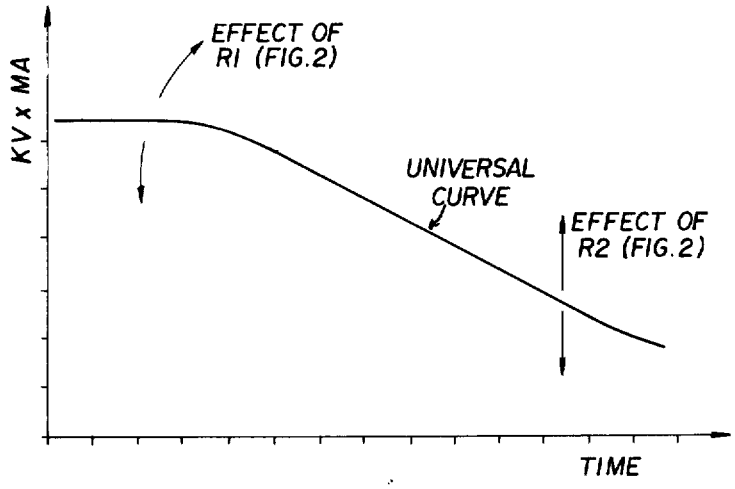
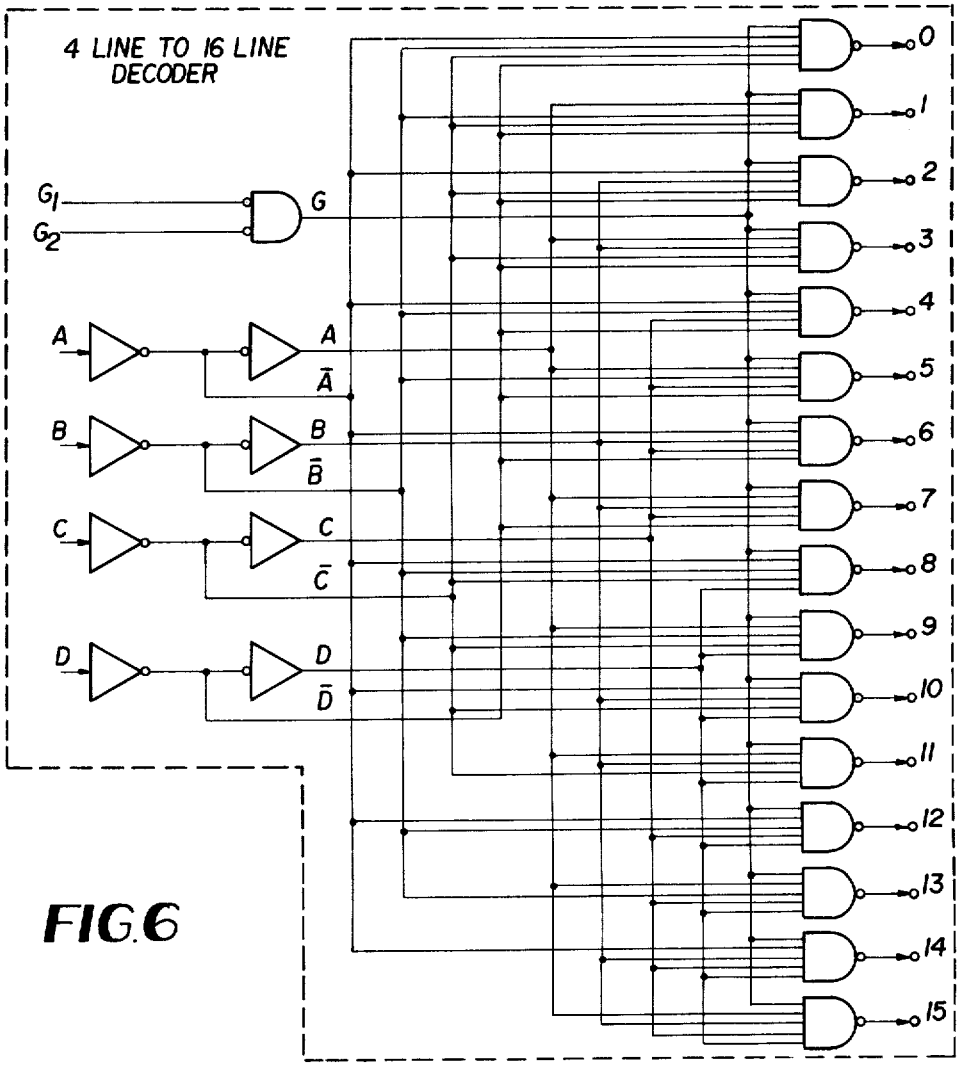
FIG. 6

X-RAY TUBE PROTECTION CIRCUIT

BACKGROUND OF THE INVENTION

This invention relates to X-ray tube protective circuits and more particularly to improved means for automatically preventing X-ray exposures under overload conditions.

Conventional high powered X-ray tubes normally include tungsten filament encased in a cathode cup which is mounted a short distance away from a rotating tungsten anode. The anode, in turn, is connected to a motor armature and bearing assembly with the entire structure mounted within a glass envelope of the X-ray tube. The tube is placed such that the motor armature and that portion of the glass envelope surrounding it are within the motor stator winding. When this stator winding is energized, the anode rotates so that during the X-ray exposure new areas of the anode are brought within the electron beam cross section. The thermal capacity, that is the maximum X-ray exposure is determined by the energy levels per exposure, which is a function of peak power expressed in terms of voltage (kV) × current (mA) and, the exposure time (seconds), the area on the anode subtended by the electron beam as well as the shape, and finally the speed of rotation of the anode.

In an effort to obtain the maximum output per exposure of the X-ray tubes utilized, each manufacturer attempts to rate its tube at the maximum possible value per exposure such that the anode is brought almost to the point of melting during each X-ray exposure. The X-ray tube manufacturers accordingly publish curves called "X-ray tube anode rating curves" which describe the maximum exposure for each X-ray tube under the various conditions of its operation.

Conventional protective circuits which have been used for many years in X-ray generators are based on generating each of the separate functions of maximum instantaneous power versus time by means of a constant voltage power supply source feeding voltage divider switch decks which are mounted on the same shaft of the X-ray exposure time switch. If the X-ray generator for example operates with two X-ray tubes and if each X-ray tube has two different focal spot sizes and the anodes are permitted to rotate at both standard speed (3000 rpm) or ultra speed (9000 rpm) eight separate switch decks would be required. If one were to replace one tube type with another tube type, it became necessary that appropriate switch decks had to be replaced in the field.

A more recent attempt to overcome the maintenance problem associated with the multiple switch decks is taught in U.S. Pat. No. 3,838,285, entitled "X-ray Tube Anode Protective Circuit", M.P. Siedband, et al. That invention eliminates the multiple switch deck requirement by making use of a single resistive voltage divider switch simulating an imperically derived generalized tube rating curve which is then modified, i.e. tilted and/or offset to fit the particular tube used.

Another means of providing a protective circuit is taught in U.S. Pat. No. 3,746,862, entitled "Protective Circuit For X-ray Tube and Method of Operation", D.F. Lombardo, et al. which discloses a signal generating circuit for developing a limit signal which varies in value with respect to time in accordance with a maximum tube rating signal together with a programming circuit for developing a program signal having a value representative of a preselected signal to be applied to the X-ray tube and a comparator circuit for developing an interrupt signal if the program signal exceeds the value of the limit signal.

SUMMARY

Accordingly, the present invention is directed to an improvement in high set protective circuitry wherein a comparison is made between the power selected and the maximum power allowable by the use of a read only memory or simply a ROM programmed with the maximum power points for every time station for every tube and in every mode desired which when addressed by a binary coded word, outputs a binary word corresponding to the maximum power allowable for exposure setting selected. The digital output from the ROM is converted to an analog voltage which is then fed to a conventional comparator circuit which receives as its other input an analog signal corresponding to the power selected and accordingly permits or inhibits further operation.

DESCRIPTION OF THE DRAWINGS

FIG. 3 is a graph illustrative of the operational characteristic of the circuitry shown in FIG. 2;

FIG. 6 is an electrical circuit diagram of the decoder apparatus shown in FIG. 5.

DESCRIPTION OF THE PREFERRED EMBODIMENT

Figure 1:
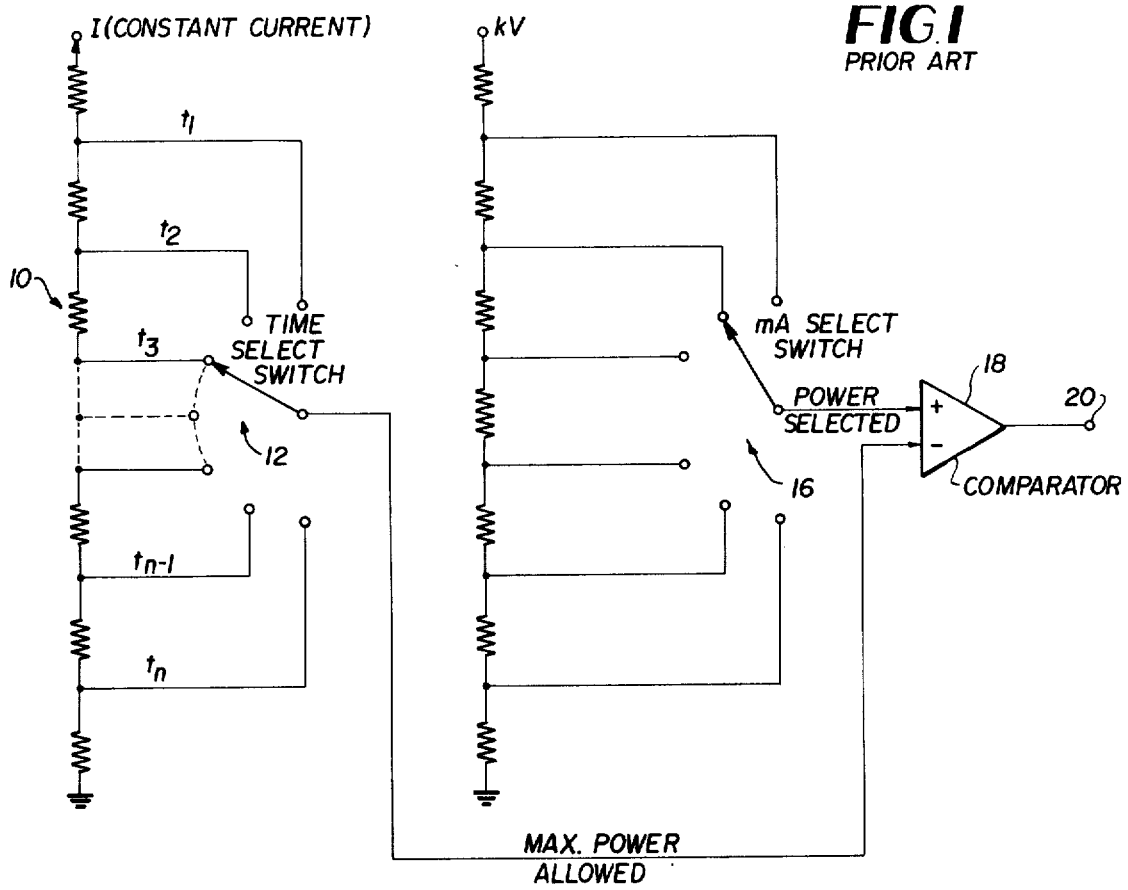
FIG. 1 PRIOR ART
FIG. 1 is an electrical schematic diagram illustrative of a first type of prior art apparatus utilized for high set protection of an X-ray tube.
Figure 2:
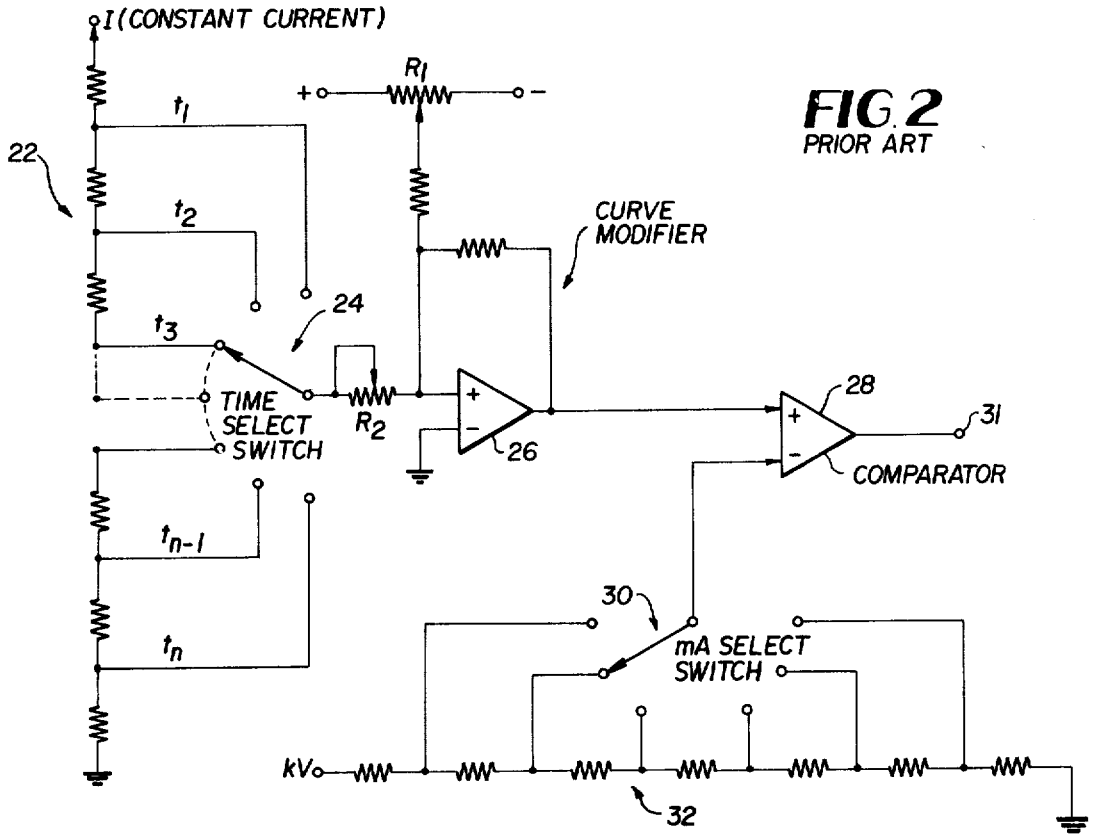
FIG. 2 PRIOR ART
FIG. 2 is an electrical schematic diagram of second type of prior art high set protection apparatus.

Prior to discussing the preferred embodiment in specific detail, mention is first made to the prior art technology as shown in FIGS. 1 and 2. FIG. 1 illustrates one of the earlier well known means of obtaining high set protection. A voltage divider network or switch deck 10 is connected to a constant current source I and provides a plurality of circuit nodes exhibiting voltages corresponding to maximum allowable power for the respective time $t_1, t_2 \ldots t_{n-1}$ and $t_n$, as obtained from the manufacturer's rating chart curves. Each circuit node is connected to a "Time Select" switch 12. The resistor values are selected such that the constant current I generates analog voltages at the times $t_1$, $t_2$, etc. that represents the maximum power that can be applied to a particular X-ray tube, focal spot and anode speed. Accordingly a plurality of switch decks are required for the various operational modes. Additionally, the voltage proportional to the kV is applied to a resistive voltage divider network 14 which has circuit nodes connected to an "mA Select" switch 16 providing an analog of a plurality of kV × mA or peak power power levels of exposure which can be operator selected.

A comparator amplifier 18 compares the maximum power allowed for a selected time against the desired power selected by the operator and determines whether the exposure is within the allowable tube rating. If the power selection from the "mA select" switch 16 exceeds the power allowed, an output signal appears at output terminal 20 which is coupled to suitable circuitry for preventing an exposure. Such circuit means are well known to this skilled in the art. This method for high set protection normally requires a plurality of switch decks 10 for a typical installation which if the X-ray tube type is changed, an entirely new set of switch decks must be provided, which is not only very inconvenient, but entails considerable expense.

A more recent means of obtaining high set protection which is more convenient, less expensive but less accurate is shown in FIG. 2 where but a single resistive switch deck 22 is coupled to the "Time Select" switch 24. Such a teaching appears in the aforementioned U.S. Pat. No. 3,838,285. The resistor values are selected such that the voltage at any selected time station $t_1 \ldots t_n$ represents the maximum power that can be applied for a generalized or universal standard type of X-ray tube, having an imperically derived rating chart curve generated from a study of the curves of many currently available X-ray tubes. Such a universal curve is shown in FIG. 3, which due to its linear characteristic, is an approximation of the exact non-linear tube rating chart curves. The curves as shown in FIG. 3 is made to coincide with a particular tube rating chart curve by an operational amplifier 26 whose gain and offset voltage is varied by a pair of variable resistors $R_1$ and $R_2$. The variable input resistor $R_1$ rotates the curve of FIG. 3 such that it coincides with the high power points corresponding to a short time while the potentiometer type of variable resistor $R_2$ moves or translates the curve up or down so that it coincides with the low power points for longer exposure times. Thus by adjusting $R_1$ and $R_2$, the universal curve is made to approximate an actual curve.

Like the previous means (FIG. 1) an operational amplifier 28 compares an analog voltage corresponding to the maximum power allowed for a selected time station $t_1 \ldots t_n$, i.e. the output of amplifier 26 against an analog voltage corresponding to the actual power selected, which analog voltage is developed by the switch 30 and voltage divider network 32 and operates in the same manner as amplifier 18 shown in FIG. 1 to either prevent or allow an X-ray exposure by a control signal appearing at terminal 31.

The system shown in FIG. 2 as noted above requires only one high set switch deck 22 for the timer switch 24 but does require a pair of variable resistors $R_1$ and $R_2$ for every focal spot and speed selected. Thus for a typical installation, 16 variable resistors are required and in the event that an X-ray tube is changed, eight of the variable resistances must simply be readjusted for that particular X-ray tube instead of having the switch decks replaced. For a more detailed explanation of this concept, reference may be made to the aforementioned U.S. Pat. No. 3,838,285.

Figure 4:
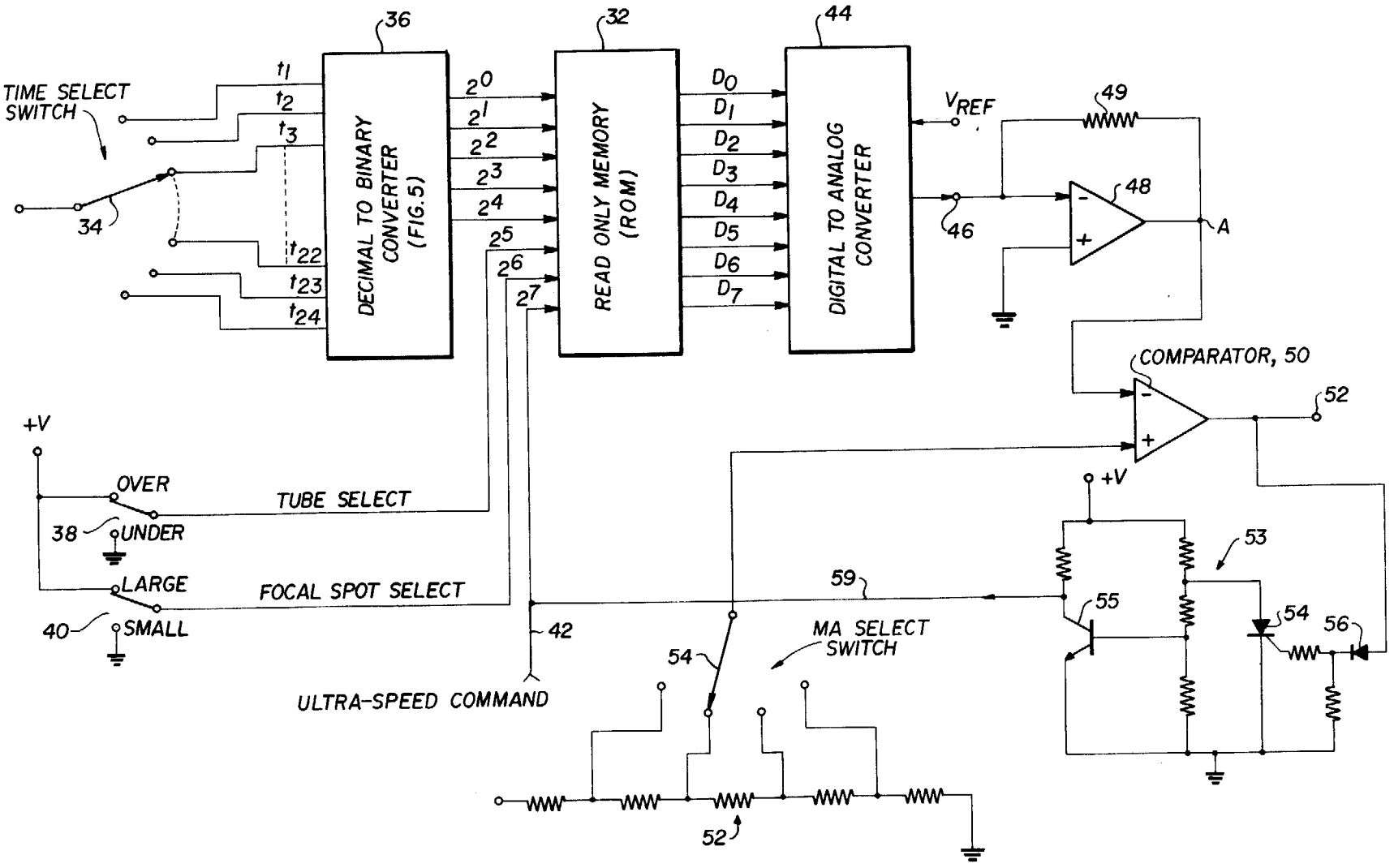
FIG. 4 is an electrical circuit diagram illustrative of the preferred embodiment of the subject invention.
Figure 5:
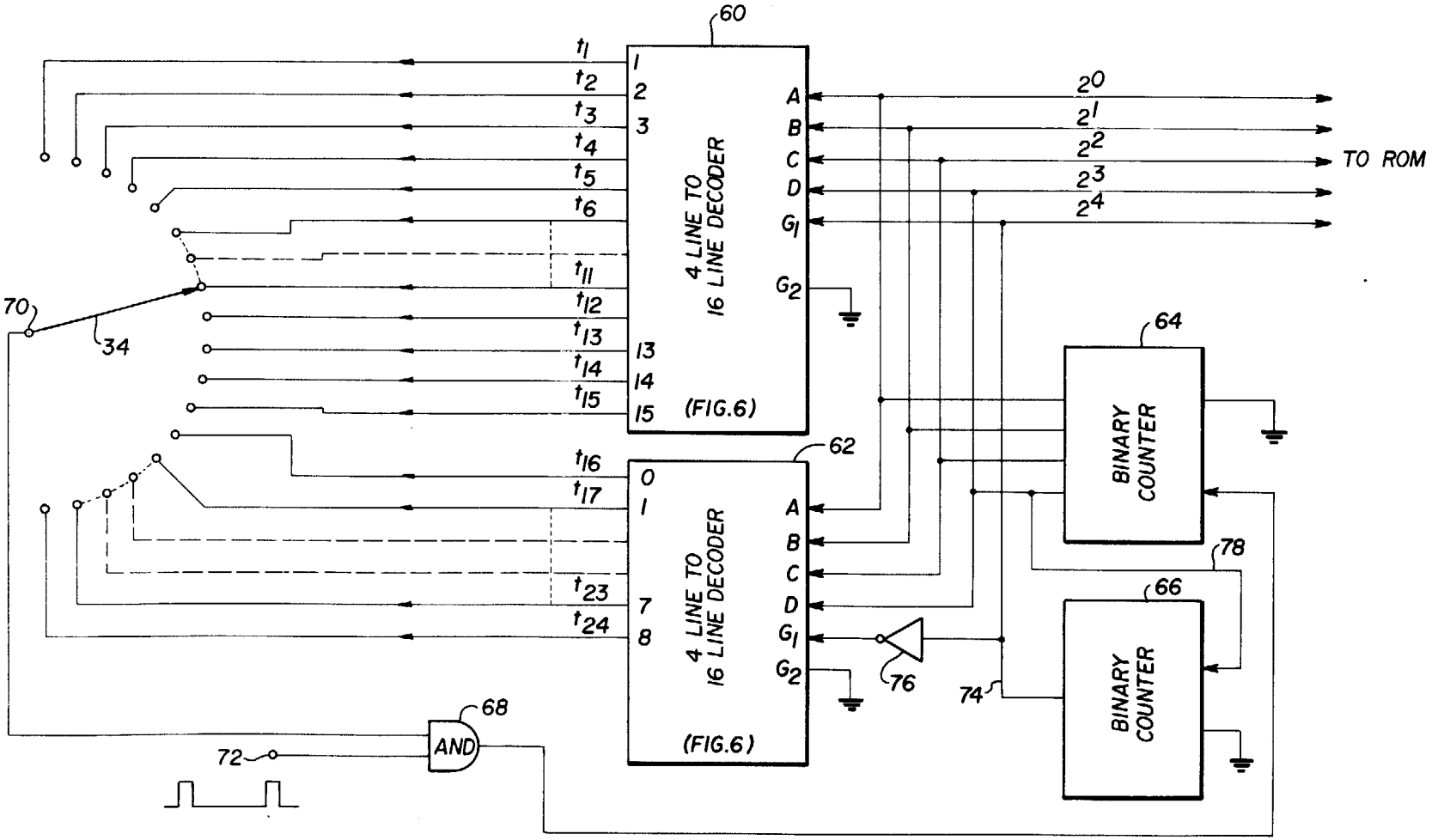
FIG. 5 is an electrical circuit diagram further illustrative of the decimal to binary converter shown in FIG. 4.

Turning now to the subject inventive concept, reference is now made to FIGS. 4, 5 and 6, which discloses what is at present considered to be the preferred embodiment of the subject invention. In FIG. 4, an eight bit binary digital number or word $2^0, 2^1 \ldots 2^7$ is generated for addressing a pre-programmed read only memory 32, hereinafter referred to as a ROM. The ROM is pre-programmed with digital information corresponding to maximum allowable power for a plurality of exposure times, one or more tubes, one or more focal spots, and one or more anode speeds in a manner to be described.

The first five bits $2^0 \ldots 2^4$ of the address word to the ROM 32 corresponds to 24 separate time stations, $t_1, t_2 \ldots t_{24}$, which are operator selectable by means of a variable "Time Select" switch 34. A plurality of signal lines for each of the times $t_1 \ldots t_{24}$ couple to a decimal to binary converter 36. The last three bits $2^5$, $2^6$ and $2^7$ of the address word are generated in response to tube focal spot and anode speed selection, respectively, in accordance with the operator selected position of respective single pole two position switches 38 and 40 and means, not shown, coupled to conductor 42 which is adapted to receive an "ultra-speed" command signal.

The position of Time Select switch 34 for a time $t_1$, for example, causes the decimal to binary converter 36 shown in detail in FIG. 5 to provide a binary digital output of 00000, while an output of 00001 is provided for time $t_2$. The time for $t_{24}$ accordingly causes a digital output of 10111 to be provided. The tube select signal line for the $2^5$ bit is adapted to be a binary 1 if the overtable tube is selected, and at a binary 0 if the undertable tube is selected. In a like manner, the focal spot signal line for the bit $2^6$ is a binary 1 if the large focal spot is selected, but at a binary 0 level if the small focal spot is selected.

Illustratively, the ROM 32 comprises a 256 word by eight bit erasable and electrically reprogrammable read only memory such as type 8702A manufactured by the Inteil Corporation. As an example of the manner in which maximum allowable power to the X-ray tube is converted to binary form for storage in an 8702A type ROM, assume for purposes of illustration that the maximum power for a particular X-ray tube, focal spot, and anode speed is 51.2kW for the time station $t_1$. For a 256 word storage the least significant bit (LSB) of an eight bit word comprises $51.2/256\ kW = 0.2\ kW$. Accordingly the following table is developed.

TABLE I

| | |
|---|---|
| 1st bit | 0.2 kW |
| 2nd bit | 0.4 kW |
| 3rd bit | 0.8 kW |
| 4th bit | 1.6 kW |
| 5th bit | 3.2 kW |
| 6th bit | 6.4 kW |
| 7th bit | 12.8 kW |
| 8th bit | 25.6 kW |

Taking time station $t_{11}$ as a further illustrative example, one would find from the manufacturer's published curve of the maximum power allowed for the particular focal spot and speed. If, for example, the power allowed is 15 kW, this power comprises the sum of 12.8 kW + 1.6 kW + 0.4 kW + 0.2 kW which from Table I correspond to the 7th bit, 4th bit, 2nd bit, and 1st bit, respectively. If a binary 1 represents power for each bit of the four partial powers while a binary 0 corresponds to the absence of power, then the binary representation for 15 kW is the binary number 01001011. In order to address the ROM 32 for the 11th time station and for a particular combination of, for example, the upper tube small focal spot and standard speed, the binary address would be 01001010.

By this method one can derive a binary equivalent of the maximum power allowed for all 24 time stations $t_1 \ldots t_{24}$ and all eight different combinations of tube, focal spot and speed. The total number of addresses is $24 \times 8 = 192$. At each address there is a group of eight bits representing power. Accordingly, the total bits in the ROM required are $192 \times 8 = 1536$ which is easily within the capacity of aforementioned Inteil Corporation type 8702A ROM. All that is required for programming is to make a specific address and program that location with a binary eight bit word which represents a certain power point.

Thus following preprogramming of the ROM 32, an eight bit binary address $2^0, 2^1 \ldots 2^7$ causes an eight bit binary word $D_0, D_1, D_2 \ldots D_7$ of the maximum power allowable for the manually selected positions of the four switches 34, 38, 40 and 42. The binary digital outputword $D_0 \ldots D_7$ from the ROM 32 is fed to a digital to analog converter 44, which converts the digital input to an analog voltage representative of the maximum power allowed which then appears at terminal 46. This analog voltage is scaled in an operational amplifier 48 having a feedback resistor 49 and applied to a comparator amplifier 50, which receives at its other input an analog voltage of the desired power selected via a voltage divider network 52 and an "mA Select"switch 54 as in prior art practice.

Further if for example a digital output word of 01001011 which represents 15 kW is outputted as the bits $D_0, D_1, D_2 \ldots D_7$ from the ROM 32, the digital analog converter 44, which for example comprises a monoDAC-08 digital to analog converter manufactured by Precision Monolithics Incorporated, and the amplifier 48 together with its feedback resistor 49 coupled to the output terminal 46 is adapted to provide a voltage at circuit junction A of, for example 1.5 volts DC for a power of 15 kW. The operation of the digital to analog converter 44 and scaling amplifier 48, accordingly, develops an output according to the following table, which shows the analog output in terms of the binary digital input.

TABLE II

| | | |
|---|---|---|
| 1st bit | (LSB) | 0.02 V DC |
| 2nd bit | | 0.04 V DC |
| 3rd bit | | 0.08 V DC |
| 4th bit | | 0.16 V DC |
| 5th bit | | 0.32 V DC |
| 6th bit | | 0.64 V DC |
| 7th bit | | 1.28 V DC |
| 8th bit | | 2.56 V DC |

And thus, $15\ kW = 01001011 = 0 + 1.28V + 0 + 0 + 0.16V + 0 + 0.04V + 0.02V = 1.50\ V\ DC$.

In addition to the output of the comparator amplifier 50 being coupled to an output terminal 52, which is adapted to provide the enable or inhibit function of exposure, a silicon controlled rectifier (SCR) 54 and transistor 55.SCR 54 has its gate electrode coupled to the output of comparator amplifier 50 by means of a diode 56. Transistor 55 is normally conductive; however, when SCR 54 is turned on by a "high" signal output from comparator 50, the forward bias on the base of transistor 55 is removed turning it off. The voltage source +V is now applied through conductor 59 to the $2^7$ address bit.

The voltage at circuit junction A is compared with the selected power indicated by the position of the "mA Select" switch 54. If for example both inputs (+ and − ) to the comparator amplifier 50 is 1.5 V DC, its output will not change, in other words, remain in a binary "low" state. If, however, one selects a greater power from the voltage divider 52, the output of comparator amplifier 50 will go "high", which acts to turn SCR 54 on, at which time the +V voltage appearing on conductor 59 to be coupled to the address bit $2^7$, causing another binary output word from the ROM 32 to be provided corresponding to "ultra speed" if it has not already been selected. The comparator 50 now compares high set for ultra speed and determines whether an exposure is allowable. If exposure is still not allowable, the output of the comparator at terminal 52 is used to either disable the exposure circuit and/or turn on an alarm, or used to reduce kV on the X-ray tube until an exposure is permissible.

In order to more fully understand the manner in which the 24 time stations $t_1 \ldots t_{24}$ generate the five binary address bits $2^0, 2^1 \ldots 2^4$, reference is now made to FIGS. 5 and 6. The decimal to binary converter 36 shown in FIG. 4 is comprised of two four to 16 line decoders 60 and 62 shown in detail in FIG. 6, as well as a pair of binary counters 64 and 66, the first of which is connected to the output of an AND gate 68 which has one input coupled to the wiper contact terminal 70 of the "Time Select" switch 34 while the other input is connected to a terminal 72 to which is applied 120 Hz pulse train supplied from a source not shown.

The decoder circuits 60 and 62 allow decoding of a four bit binary coded input into one of 16 separate outputs as shown in FIG. 6. Such a device is typically illustrative of a type DM54154/DM74154 four to 16 line decoder/demultiplexer series 54/74 manufactured by National Semiconductor, Inc. The inputs are designated A, B, C and D, along with two strobe lines $G_1$ and $G_2$ with the outputs being labeled 0 through 15. In order to perform the decoding function both strobe lines $G_1$ and $G_2$ have to be in the binary "low" state. Accordingly, the both $G_2$ terminals of the decoders 60 and 62 are grounded while the respective $G_1$ terminal is connected to the output line 74 from the binary counter 66 with a logic inverter 76 coupled between the $G_1$ terminal of decoder 62 and line 74. The two binary counters 64 and 66, moreover, are typically of the type SN7493 integrated circuit modules manufactured by Texas Instruments.

In the configuration shown in FIG. 5, all of the time output lines for $t_1$ through $t_{24}$ are normally "high" with the exception of the one selected by the "Time Select" switch 34, which in FIG. 5 is the line for $t_{11}$. Any subsequent selected time will cause a binary "high" signal to be coupled to the AND gate 68 from the switch terminal 70, which acts to enable the AND gate 68 and coupled the 120 Hz pulse train to the counters 64 and 66 coupled via signal line 78. The counters are cycled until the five bit output $2^0, 2^1 \ldots 2^4$ of the counters 64 and 66 represents the time switch position which is evidenced by a "low" state at the switch wiper contact connected to terminal 70 whereupon the AND gate 68 is again disabled. The resulting binary number will appear on the appropriate lines for the bits$2^0, 2^1 \ldots 2^4$.

Thus what has been shown and described is a high set protection circuit for an X-ray tube having a read only memory (ROM) preprogrammed with binary information corresponding to the maximum power points for every time station for every tube and operating mode, which when selectively addressed, provides a binary output which is converted to an analog voltage which is compared to an analog voltage corresponding to desired power with the resultant comparison voltage therefrom being adapted to operate circuit means which either allow or disallow an X-ray exposure.

Although the present invention has been shown and described with respect to a preferred embodiment thereof, it will be readily apparent to those skilled in the art that various changes and modifications may be resorted to without departing from the spirit and scope of the invention as defined by the dependent claims.

Accordingly, I claim as my invention:

1. In X-ray tube anode protective circuitry including circuit means being operated by the output of comparator circuit means which compares selected values of an analog voltage representative of maximum allowable power obtained from X-ray tube rating chart curves with an analog voltage representative of desired power and accordingly controls further operation of an X-ray exposure depending upon whether or not preselected operating parameters are outside of the ratings of the X-ray tube, the improvement comprising:

a digital memory having selectively addressed memory locations programmed with binary information at said locations corresponding to maximum allowable power for specific operating parameters obtained from predetermined tube rating chart curves;

memory address means coupled to said memory and being operable to address a predetermined memory location in response to at least one selected operating parameter, said memory becoming operative thereby to output a multibit binary digital output signal representative of the maximum allowable power for said at least one selected operating parameter;

digital to analog converter means coupled to said memory and being responsive to said binary digital output signal to generate an analog maximum signal therefrom;

means providing an analog signal representative of a desired operating power; and means coupling said two analog signals to said comparator circuit means.

2. The protective circuitry as defined by claim 1 wherein said digital memory comprises a read only memory.

3. The protective circuitry as defined by claim 2 wherein said address means includes means for selecting a plurality of operating parameters including a plurality of exposure times, X-ray tubes, facal spots and anode speeds.

4. The protective circuitry as defined by claim 2 wherein said memory address means includes circuit means for selecting operating parameters for a plurality of exposure times.

5. The protective circuitry as defined by claim 4 wherein said circuit means includes a decimal to binary converter circuit and operator controlled exposure time select switch means for said plurality of exposure times coupled thereto, said converter circuit being operable in response to a selected switch position of said time select switch means to generate a respective binary digital address signal for each exposure time selected.

6. The protective circuit as defined by claim 5 wherein said decimal to binary converter circuit comprises a first numbered input line to a second numbered output line decoder circuit, binary counter means having an input line and like first numbered output lines respectively coupled to the said first numbered input lines of said decoder means, a binary logic gate having a pair of input terminals and an output terminal, one of said pair of input terminals being coupled to a source of electrical pulse signals and said output terminal being coupled to said input line of said binary counter means, and wherein said time select switch means includes like second numbered fixed switch contacts respectively coupled to said second numbered output lines of said decoder means and a movable switch contact coupled to the other input of said logic gate, whereby a time select switch change causes the movable switch contact to contact a different fixed switch contact which in turn causes said logic gate to be enabled and cause pulse signals to be coupled to said counter means, said counter means being operative to count said pulse signals until said first numbered output lines provide a binary digital representation of exposure time corresponding to the changed time select switch position and whereupon said logic gate becomes disabled by a signal from said decoder circuit to block said pulse signals from being coupled to said counter means.

7. The protective circuitry as defined by claim 6 wherein said logic gate comprises an AND gate.

8. The protective circuitry as defined by claim 4 wherein said memory address means additionally includes circuit means for selecting operating parameters for a plurality of X-ray tubes.

9. The protective circuitry as defined by claim 4 wherein said memory address means additionally includes circuit means for selecting operating parameters for a plurality of X-ray tube focal spots.

10. The protective circuitry as defined by claim 4 wherein said memory address means additionally includes circuit means for selecting operating parameters for a plurality of X-ray tube anode rotational speeds.

* * * * *